United States Patent [19]

Springmann

[11] 4,141,707

[45] Feb. 27, 1979

[54] CRYOGENIC LIQUEFACTION

[75] Inventor: Helmut Springmann, Brucknerweg, Fed. Rep. of Germany

[73] Assignee: Linde Aktiengesellschaft, Wiesbaden, Fed. Rep. of Germany

[21] Appl. No.: 814,242

[22] Filed: Jul. 8, 1977

[30] Foreign Application Priority Data

Jul. 10, 1976 [DE] Fed. Rep. of Germany ..... 2631134

[51] Int. Cl.[2] ..... F25J 1/02; F25J 3/04

[52] U.S. Cl. ..... 62/9; 62/40; 62/39

[58] Field of Search ..... 62/38, 39, 40, 9

[56] References Cited

U.S. PATENT DOCUMENTS

| | | | |
|---|---|---|---|
| 2,265,558 | 12/1941 | Ward et al. | 62/39 |
| 3,194,025 | 7/1965 | Grossman | 62/40 |
| 3,205,669 | 9/1965 | Grossman | 62/38 |
| 3,645,106 | 2/1972 | Gaumer et al. | 62/9 |

OTHER PUBLICATIONS

Progress in Refrigeration Science and Technology, Jul and Jul, pp. 34–39, Pergamon Press, 1960.

*Primary Examiner*—Norman Yudkoff
*Attorney, Agent, or Firm*—Millen & White

[57] ABSTRACT

In a process for the liquefaction of air or of primary components thereof comprising passing liquefied closed-cycle refrigeration medium in indirect heat exchange relationship with said air or primary components thereof, and wherein the refrigeration value of the closed-cycle medium is produced by compressing said medium, partially condensing compressed medium in several indirect heat exchange stages, and wherein condensate from each stage is expanded, reheated, and revaporized in said indirect heat exchange stages counter-currently to the cycle medium being partially condensed, and the revaporized medium is recompressed, the improvement which comprises recovering resultant uncondensed vapor medium from the last serially connected heat exchange stage, engine expanding said vapor and passing resultant expanded vapor in indirect heat exchange relationship with liquefied air or primary components thereof to subcool same, and wherein the cycle medium is a mixture of nitrogen and hydrocarbon whereby only a single compressor is required for compressing said cycle medium in said process.

8 Claims, 1 Drawing Figure

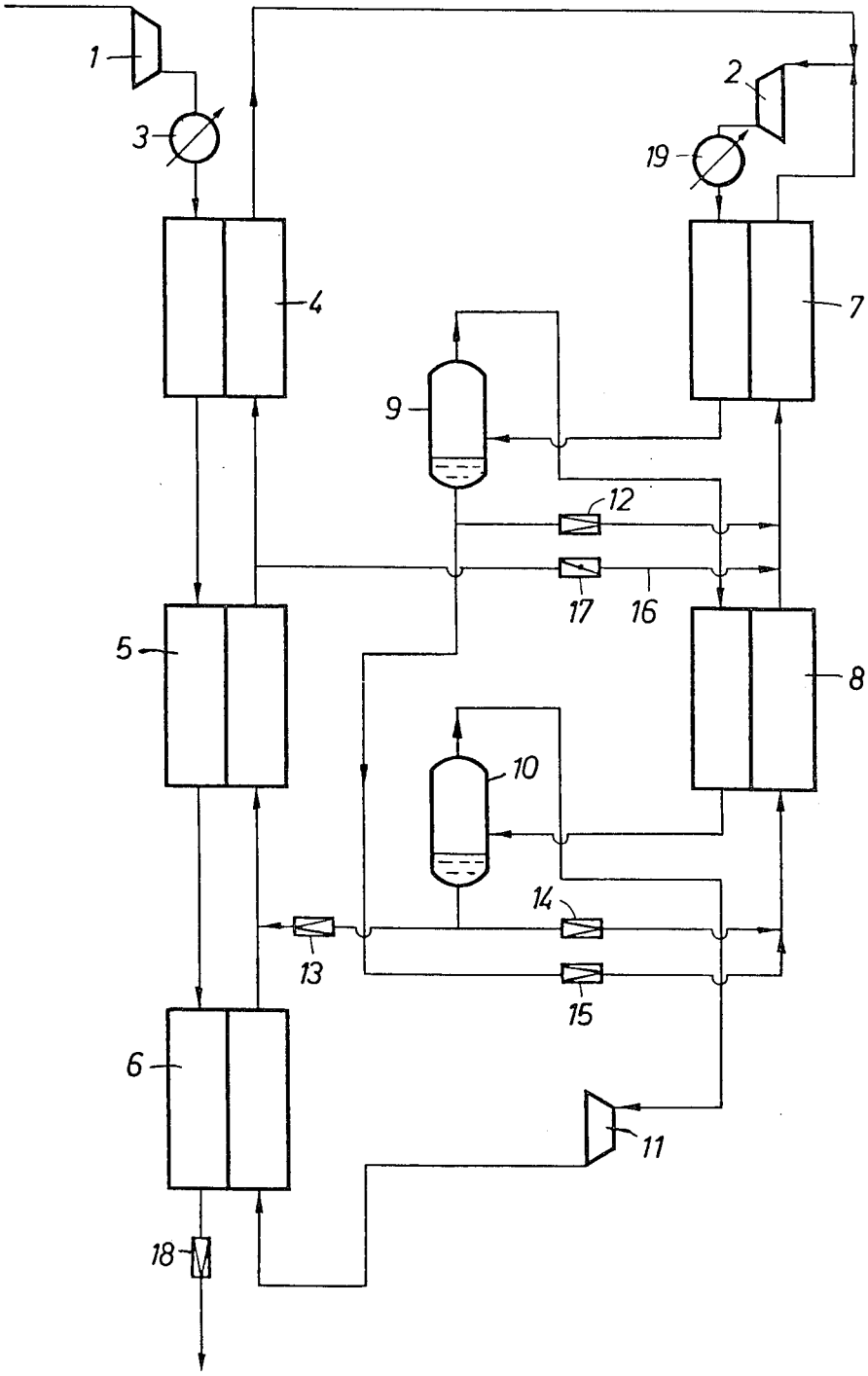
1
2
3
19
4
7
9
12
17
16
5
8
10
14
13
15
6
11
18

CRYOGENIC LIQUEFACTION

BACKGROUND OF THE INVENTION

This invention relates to a process for the liquefaction of air, or of primary air components thereof, by heat exchange with a cycle medium containing nitrogen and hydrocarbons, wherein the cycle medium is, in several stages, cooled and partially condensed, and the liquid portions obtained during the partial condensation are expanded and rewarmed countercurrently to mixture to be cooled, vaporized, and recompressed. By "primary air components" is meant oxygen or nitrogen.

It is conventional in connection with the liquefaction of air or nitrogen to produce the required refrigeration by processes operating in accordance with the Linde or Claude principles. In these processes, especially in the Linde method, large temperature differences are encountered between the cycle medium to be warmed and the cycle medium to be cooled, thereby resulting in exergonic losses. Consequently, these processes have the disadvantage of a large specific energy consumption. To avoid this disadvantage, it is known (Leiden Communications, Supplement No. 76*a*) to utilize single-component cascaded cycles for refrigeration production. Such a process, while resulting in a low specific energy consumption, requires a separate compressor and ancillary apparatus for each cycle of the cascade, thereby requiring an extremely high capital outlay for such a plant.

SUMMARY OF THE INVENTION

An object of this invention is to provide a modified process of the type described above for air, or primary air components, and paricularly nitrogen liquefaction, and especially a process distinguished by low operating and investment costs.

Upon further study of the specification and appended claims, further objects and advantages of this invention will become apparent to those skilled in the art.

To attain these objects, the process provides the steps of engine-expanding the gaseous portion present after the last partial condensation and warming resultant expanded gas in heat exchange with liquid product.

By including these steps, a process is provided wherein the cooling curves are closer fitting to the warming curves in the enthalpy-temperature diagram. Thereby, the temperature differences during heat exchange and the concomitant exergonic losses are substantially diminished, resulting in a process having a low specific energy consumption. In addition, because a mixture cycle is utilized for the production of cold — the expenditure in apparatus is substantially lower than in case of a process operating with cascaded single-component cycles.

Another aspect of this invention contributing towards an even further reduction in the temperature differences occurring during heat exchange is, in accordance with a particularly advantageous embodiment of the invention the step of subdividing the liquid obtained during the partial condensation of the first stage into two partial streams. The first of these streams is reheated in indirect heat exchange with the fluid stream flowing toward the phase separator of the first stage, and the second partial stream is admixed to the liquid obtained during the partial condensation of the second stage and is warmed and vaporized together therewith.

The cycle medium ordinarily utilized is preferably a mixture of nitrogen, natural gas, ethylene, and propane. In this connection, according to a particularly advantageous aspect of this invention, the nitrogen content in the cycle medium predominates and preferably comprises at least 40% of nitrogen. Thereby the temperature differences are further reduced during the heat exchange between the cycle medium to be cooled and the cycle medium to be warmed, and especially in the cold portion of the heat exchangers.

If flammability of the cycle medium is a very important consideration because of plant location or insurance costs, or the like, it is advantageous to utilize in the cycle medium a mixture of non-inflammable halogenated hydrocarbons instead of unsubstituted hydrocarbons. Preferred compounds for this mixture are: $CCl_2F_2$, $CHClF_2$, and $CClF_3$. Generally, a cycle medium based on a mixture of nitrogen and halogenated hydrocarbons would have the following composition on a molar basis:

| | GENERALLY | PREFERABLY |
|---|---|---|
| $N_2$ | 30 - 50% | 40% |
| $CHClF_2$ | 10 - 30% | 20% |
| $CClF_3$ | 30 - 50% | 40% |

BRIEF DESCRIPTION OF THE DRAWING

For the purpose of facilitating an easy understanding of the prevention, the attached drawing is a schematic representation of the preferred embodiment of the aspect of the invention relating to the liquefaction of nitrogen.

DETAILED DESCRIPTION OF THE PREFERRED EMBODIMENT

Referring to the drawing, the nitrogen liquefaction plant comprises essentially a nitrogen compressor 1, a cycle compressor 2, heat exchangers 3–8, phase separators 9 and 10, and expansion turbine 11.

10,000 $Nm^3/h$. of nitrogen at ambient temperature is compressed in compressor 1 to 10 bar. After removal of the heat of compression by means of the heat exchanger 3, the nitrogen is cooled in heat exchanger 4 to its liquefaction temperature and then liquefied in heat exchanger 5. To subcool the liquid nitrogen, additional heat is withdrawn from the nitrogen by means of heat exchanger 6; this heat is transferred to the turbine discharge stream from the turbine 11. The liquid nitrogen is then expanded, if necessary, in the throttle valve 18 to the desired pressure.

A mixture cycle is provided to produce the refrigeration required for the cooling and liquefaction procedure: The cycle mixture, which has the following composition on a volumetric basis:

| | GENERALLY | PREFERABLY |
|---|---|---|
| $N_2$ | 30 - 70% | 40% |
| $CH_4$ | 20 - 60% | 40% |
| $C_2H_4$ | 0 - 20% | 10% |
| $C_3H_8$ | 0 - 20% | 10% |

is compressed in compressor 2 from about 2 bar to 30 bar and cooled in heat exchanger 19 to about 77° to 27° C. After the cycle mixture has been further cooled in heat exchanger 7 to about 27° to −108° C., its heavy components (propane, ethylene), as well as a minor portion, e.g., about 5 to 10%, of the methane, are condensed in the liquid phase. The liquefied proportion is separated in separator 9 and subdivided into two partial streams. The first of the two partial streams (about 50 to 70, preferably about 60% of the total liquefied portion is expanded in a throttle valve 12 to the intake pressure of the compressor 2 and vaporized in heat exchanger 7 indirectly against the cycle mixture flowing toward the phase separator 9 and then recycled to the intake side of the compressor 2. The stream withdrawn in the gaseous phase from the separator 9 is partially liquefied, about 40 to 60%, in heat exchanger 8 and separated in phase separator 10. The resultant separated liquid, predominantly methane, is split into two streams, about 20 to 40% being expanded in throttle valve 13 and the remainder is expanded in throttle valve 14. The expanded liquid from throttle valve 13 is then vaporized in heat exchanger 5 in indirect heat exchange against condensing nitrogen; the resultant vapor is then heated in heat exchanger 4 and then passed to the intake side of compressor 2. In a somewhat similar manner, the expanded liquid from throttle valve 14 is vaporized in heat exchanger 8 in indirect heat exchange against condensing methane; the resultant vapor is heated in heat exchanger 7, and then also passed to the intake side of compressor 2.

The aforementioned second partial stream of the liquid obtained from phase separator 9 is expanded in throttle valve 15 and admixed to the liquid stream from throttle valve 14 to be vaporized in heat exchanger 8.

The stream withdrawn in the gaseous phase from the phase separator 10, predominantly nitrogen with minor amounts of methane, is engine-expanded in turbine 11. The thus-produced very cold, engine-expanded gas is warmed in heat exchanger 6 against liquid nitrogen thereby subcooling the latter. The resultant warmed gas is then intermixed with the liquid stream expanded in valve 13, both streams being then warmed together by indirect heat exchange contact with nitrogen and thus vaporized, and thereafter recycled to the intake side of the compressor 2. The mixing of the warmed gas and the liquid stream has the advantage, that the latent heat of the liquid is used. In practice, the liquid is distributed to the cross-sections of heat-exchanger 5 and thereby it is intermixed with the warmed gas.

To equalize the pressures between the stream warmed in heat exchanger 8 and the stream warmed in heat exchanger 5, a pressure compensation conduit 16 with a check valve 17 is provided. If one uses a cycle mixture, which has the composition described on page 3: $N_2$, $CHClF_2$ and $CClF_3$, the same process steps can be performed. In phase separator 9 the liquified proportion consists of $CHClF_2$ and in phase separator 10 the liquified proportion consists of $CClF_3$.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modification of the invention to adapt it to various usages and conditions.

What is claimed is:

1. In a process for the liquefaction of air or of primary components thereof comprising passing liquefied closed-cycle refrigeration medium being a mixture of nitrogen and hydrocarbons in indirect heat exchange relationship with said air or primary components thereof, and in indirect heat exchang relationship with the cycle medium and wherein the refrigeration value of the closed-cycle medium is produced by compressing said medium, partially condensing compressed medium in several indirect heat exchange stages, passing partial condensates to phase separators, and wherein condensate from each phase separator stage is expanded, reheated, and revaporized in said indirect heat exchange stages countercurrently to the cycle medium being partially condensed, and the revaporized medium is recompressed, the improvement wherein the condensate obtained from the phase separator of the first stage is subdivided into two partial streams; the first of these streams is expanded and then is warmed in indirect heat exchange with closed-cycle medium withdrawn from the compressor thereby partially condensing said closed-cycle medium which is then phase-separated in said first stage phase separator; the second partial stream is expanded and admixed to the condensate obtained from the phase separator of the second stage and is reheated and revaporized together therewith; resultant uncondensed vapor medium recovered from the last serially connected heat exchange stage is engine expanded, and resultant engine-expanded vapor is passed in indirect heat exchange relationship with liquefied air or primary components thereof to subcool same.

2. A process according to claim 1, wherein two seperate and distinct heat exchangers are used for warming the first and second partial streams.

3. A process according to claim 1 wherein liquid from the phase separator of the last serially connected stage is subdivided and a portion thereof is expanded and mixed with said engine-expanded vapor after the latter is used to subcool the liquefied air or primary components thereof.

4. A process according to claim 1, wherein the closed-cycle regrigeration medium comprises a mixture of nitrogen, natural gas, ethylene, and propane, said closed-cycle refrigeration medium being predominantly nitrogen.

5. A process according to claim 1, wherein the closed-cycle refrigeration medium is predominantly nitrogen.

6. A process according to claim 1, wherein the cycle medium is a mixture of $N_2$, $CHClF_2$, and $CClF_3$.

7. A process according to claim 1, wherein the liquefaction process is for the liquefaction of nitrogen.

8. A process according to claim 1, wherein closed-cycle refrigeration medium comprises a mixture predominating in nitrogen and containing methane, ethylene and propane.

* * * * *